United States Patent [19]

Eckhardt et al.

[11] Patent Number: 4,795,939

[45] Date of Patent: Jan. 3, 1989

[54] ELECTRIC LAMP BULB ATTACHMENT ARRANGEMENT

[75] Inventors: Fritz Eckhardt, Dettingen; Peter Helbig, Sontheim; Walter Schönherr, Giengen-Hürben, all of Fed. Rep. of Germany

[73] Assignee: Patent Treuhand Gesellschaft für elektrische Glühlampen GmbH, Munich, Fed. Rep. of Germany

[21] Appl. No.: 5,684

[22] Filed: Jan. 21, 1987

[30] Foreign Application Priority Data

Feb. 6, 1986 [DE] Fed. Rep. of Germany ..... 3603753

[51] Int. Cl.[4] ..... H01J 5/48

[52] U.S. Cl. ..... 313/318; 313/315; 362/368

[58] Field of Search ..... 313/318, 113, 315; 362/267, 310, 362, 296; 439/612, 613, 617, 851, 816

[56] References Cited

U.S. PATENT DOCUMENTS

| | | | |
|---|---|---|---|
| 4,386,292 | 5/1983 | Rothwell et al. | 313/113 |
| 4,533,851 | 8/1985 | Block et al. | 313/318 |
| 4,569,006 | 2/1986 | Bergin et al. | 362/267 |
| 4,609,977 | 9/1986 | Eckhardt et al. | 362/267 |
| 4,722,039 | 1/1988 | Gaugel | 362/296 |

*Primary Examiner*—David K. Moore
*Assistant Examiner*—T. Salindong
*Attorney, Agent, or Firm*—Frishauf, Holtz, Goodman & Woodward

[57] ABSTRACT

To permit connection of a high temperature resistant plastic material forming a bulb holder element (4, 15, 20) to which a light bulb (1, 14, 19) is attached in the tubular opening of the base structure (5, 16), the bulb holder element is essentially barrel-shaped to permit alignment of the bulb with respect to the base structure, and subsequent connection by welding together the plastic base structure with the plastic bulb holder element by exposure to a high-frequency field. To cause melting of the plastic, ferromagnetic material, typically a nickel-iron alloy, is located between the bulb holder element and the base structure, for example in form of a ring (11) snapped into a groove (12) formed on the holder element.

17 Claims, 3 Drawing Sheets

ELECTRIC LAMP BULB ATTACHMENT ARRANGEMENT

Reference to related application, assigned to the assignee of the present application, the disclosure of which is hereby incorporated by reference: U.S. Ser. No. 005,685, filed Jan. 21, 1987, Gaugel, now U.S. Pat. Nos. 4,722,039; 4,609,977, issued Sept. 2, 1986, Eckhardt.

The present invention relates to electric lamps, and more particularly to electric lamps suitable for use as vehicular and especially automotive head lamps in combination with a reflector, where the position of the light emitting element within a light bulb must be accurately related to the geometry of a reflector.

BACKGROUND

Electric lamps usually have a lamp bulb of a transparent material, such as lamp glass, hard glass, quartz glass or the like. Current leads extend from the bulb. A holder structure is provided to hold the bulb in position, for example in a base structure. The base structure may be of plastic. The holder structure or holding element which is interposed between the base structure and the lamp bulb itself can be connected to the base structure by high-frequency heating. The base structure has terminals secured thereto adapted for releasably connecting the electrode leads extending from the bulb to an outside current supply.

Lamps of the type to which the present invention relates and which are designed specifically for use with vehicular head lamps, typically automotive-type head lamps, are described in U.S. Pat. No. 4,609,977, issued Sept. 2, 1986, Eckhardt, assigned to the assignee of the present application, the disclosure of which is hereby incorporated by reference. The lamp described in the referenced U.S. Pat. No. 4,609,977, is a halogen incandescent lamp which is terminated in a pinch or press seal. The pinch or press seal is received in a metallic holder structure which, after adjusting and aligning the bulb with respect to a plastic base structure, is secured to the base structure by high-frequency heating.

Various types of lamps operate at temperatures and voltages so high that use of highly heat-conducting metallic holder structures for the light bulb itself which, in turn, are connected to a plastic base element, is undesirable.

THE INVENTION

It is an object to provide an electrically insulating and high-temperature resistant material as the holder for an electric bulb, and particularly for bulbs which operate at high temperature, and which, nevertheless, can be readily connected to a plastic base structure, after adjustment of the bulb with respect to the base structure; and, preferably additionally, permitting use of existing connecting machinery so that the cost of making the lamps will be low and will not be affected by high investment costs for their production.

Briefly, the base structure is a hollow element which defines an internal opening. The lamp holder structure itself is fitted into the opening of the hollow base structure, the lamp holder element retaining the bulb therein. The lamp holder element, at least in the region of seating engagement with the base structure, is made of a high temperature resistant plastic material. To permit welding together of this plastic material with the conventional plastic material of the hollow base structure, a coupling element of ferromagnetic material, preferably in sheet or foil form, is located between the lamp holder element and the hollow base structure, positioned at least in the region of seating engagement.

The arrangement has the advantage that existing high-frequency heating apparatus can be used to connect the holding structure and the base structure.

In order to permit ready adjustment of the lamp, seated in the holding structure, with respect to the base structure, both the holding structure and the base structure have circular cross section in the region of seating engagement. The lamp can, thus, be readily adjusted with respect to its height and rotary position. To additionally readily permit adjustment of an inclination of the lamp with respect to the base structure, the holder is generally or substantially barrel-shaped, that is, formed with a slightly convex outer surface in the region of seating engagement. This permits the holder element and the base structure to cooperate and engage in form of a ball joint with limited deflection, the deflection being sufficient, however, to provide for tilting or tipping adjustment of the lamp with respect to the base structure.

The ferromagnetic element forming a coupling means between the base structure and the bulb holder structure is, preferably, made from a nickel-iron alloy. It may be formed as a single continuous foil or thin plate or sheet, constructed as a ring and fitted into a groove formed on the holder structure or element; alternatively, a plurality of small plates, sheets or foil inserts may be positioned between the base structure and the holder element. Upon exposing of the adjusted, aligned and assembled bulb holder structure and base structure to a high-frequency field, the plastic material of the holder element and of the base structure will melt together in the region of the ferromagnetic material, thus forming a tight, immovable connection with the bulb in appropriate alignment in the base structure.

The attachment arrangement is also suitable for retaining high-pressure discharge lamps. High-pressure discharge lamps require high-voltage firing pulses in the order of between 15 to 20 kV. The lamp operating temperature of such discharge lamps is in the order of 900° C. Thus, the holder element is preferably made as a two-part element, the part connected to the bulb being made of ceramic, in which the ceramic part is secured to a plastic part, the two parts being connected together by ultrasonic riveting. Other connections are possible, for example snap-together connections and the like. Reference is made to the cross-referenced application assigned to the assignee of the present invention, U.S. Ser. No. 005,685, filed Jan. 21, 1987, Gaugel, now U.S. Pat. No. 4,722,039.

DRAWINGS

FIG. 1 is a side view of the lamp, in which the base is shown in section and in which the lamp is a halogen incandescent lamp;

FIG. 2 is a view similar to FIG. 1, and illustrating an embodiment of the connection arrangement applied to a single-ended high-pressure discharge lamp; and FIG. 3 illustrates an embodiment of the connection arrangement for use with a double-ended high-pressure discharge lamp having, in turn, a holder structure as explained in detail in the referenced application assigned to the assignee of the present invention, U.S. Ser. No. 005,685, filed Jan. 21, 1987, Gaugel now U.S. Pat.

No. 4,722,039, (claiming priority of German Appln. No. P 36 03 743 of Feb. 6, 1986).

DETAILED DESCRIPTION

Figure 1:
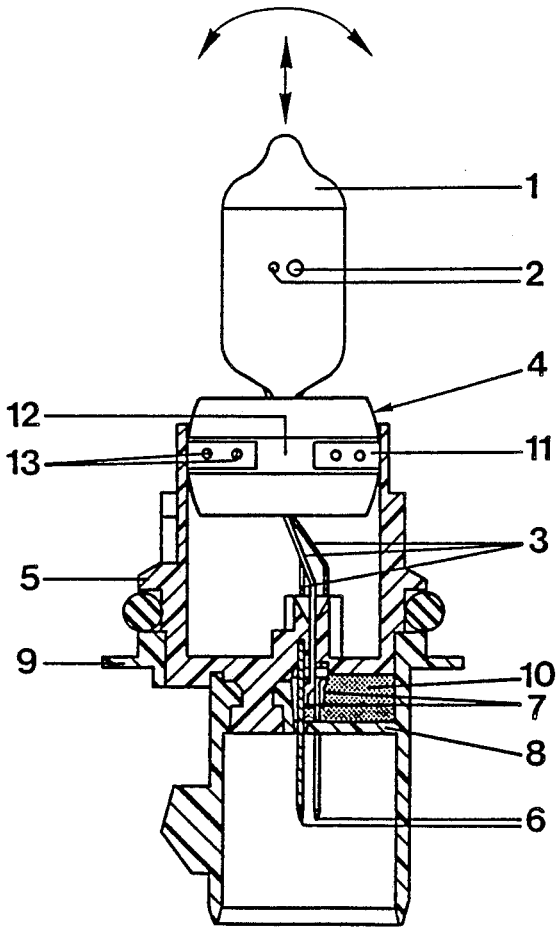

Referring first to FIG. 1: An automotive-type halogen incandescent lamp is shown schematically; the lamp has a lamp bulb 1, retaining therein two filaments shown schematically at 2. Connecting leads 3 extend from the bulb 1. The bulb 1 is terminated by a press or pinch seal, which press or pinch seal is retained and secured in a bulb holder element 4.

In accordance with a feature of the invention, the holder element 4 is made of a high-temperature resistance plastic which is generally barrel-shaped—as seen in FIG. 1. The barrel-shaped outer surfaces are formed by convex, essentially ball-shaped surfaces.

A base structure 5 is provided, generally in form of a sleeve. Three terminal blades 6 are secured in the base structure 5—of which only two are visible in the drawing. They extend, as is customary, in a direction away from the bulb 1. The current supply leads 3 are carried through suitable openings in the bottom wall of the base structure 5, and welded together at the back side thereof with the connecting blades 6.

A cover sleeve 8 is fitted on the base structure 5 to protect the connecting blades and the weld connections thereof. The cover sleeve 8 is riveted to the base structure 5, for example by ultrasonic riveting or ultrasonic connection. The cover sleeve 8 is formed with an adjustment and positioning ring 9. Any free space between the bottom wall of the base structure 5 and of the sleeve 8 is filled with a plastic resin 10.

ASSEMBLY

The lamp bulb 1 is secured in the holder element 4 in any suitable and standard and well-known manner to connect a bulb to a high-temperature plastic bulb holder element. It is difficult to seat a lamp with a pinch seal accurately in a holder element because the pinch seal terminates usually in an irregular surface. Consequently, and in order to provide accurate positioning of incandescent filaments 2 with respect to a reflector structure (not shown), it is necessary to accurately align the bulb, with the filaments 2 therein, with respect to an adjustment or positioning structure on the base. This adjustment and positioning structure, in the present invention, is being given and determined by the ring 9, integral with the cover sleeve 8.

The barrel-shaped holder element 4 permits adjustment of the bulb 1 with respect to the base structure 5 including the positioning ring 9 in all dimensions, up-down, angular rotation, and tilting or tipping of the lamp. After the lamp is appropriately adjusted with respect to the positioning ring 9, the lamp is subjected to a high-frequency field which causes the plastic material in the region of the ferromagnetic coupling structure 11 to melt, thus interconnecting the plastic materials of the bulb holder element 4 and the base structure 5. Typically, the materials of the base structure 5 and of the holder element 4 will be physically different, the element 4 having high-temperature resistant characteristics.

The ferromagnetic structure is a ring 11 which can be fitted into a groove 12 formed in the barrel-shaped element 4. Preferably, the ring 11 is formed with openings 13 therein, which permit plastic material which melts to ooze through, and additionally locate the ring and the entire structure within the base 5. This further enhances the sturdiness of the connection.

The ring 11 need not be a closed ring and entirely surround the element 4. Leaving a gap in the ring has advantages in construction and manufacture. In accordance with a suitable procedure, a tube of smaller diameter than the diameter of the groove 12 is provided and a ring-shaped section cut off therefrom. This results in a saving of material. The ring 11 is then perforated with the holes 13 and split axially, permitting the ring to snap into the groove 12 by being slipped over the barrel-shaped holder 4. The material is resilient, so that the spring force resulting in the expansion of the ring 11 retains the ring in the groove until the element 4 is welded by plastic welding to the base 5.

Figure 2:
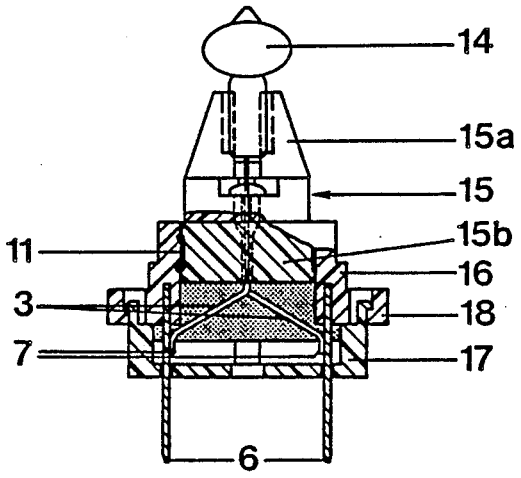
Figure 3:
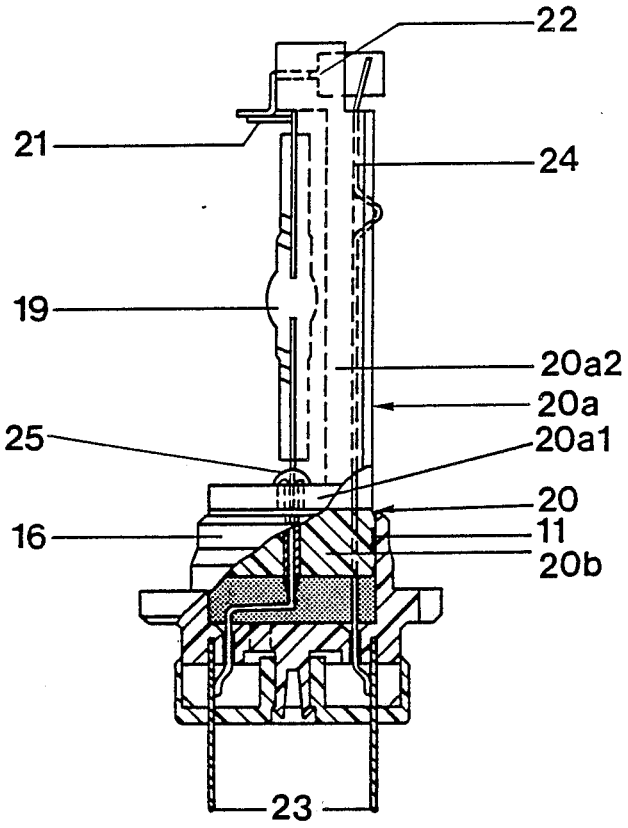

Embodiment of FIG. 2: Automotive head lamps using high-pressure discharge lamps have recently been proposed, and FIG. 2 illustrates a single-ended high-pressure discharge lamp 14 terminating in a pinch seal. FIG. 3 illustrates a double-ended high-pressure discharge lamp 19, terminating in two pinch seals.

In the description that follows, only the differences in construction over those already described in connection with FIG. 1 will be specifically referred to. The single-ended high-pressure discharge lamp 14 is carried by a two-part holder 15. High-pressure discharge lamps require ignition voltages in the form of high-voltage pulses, in the order of between 15 to 20 kV. The operating temperature is very high, in the order of about 900° C. This requires a two-part holder 15 for the lamp bulb itself which includes a ceramic element. Thus, the first part **15*a* (FIG. 2) in which the lamp itself is seated is made of ceramic. The ceramic first part 15*a* is connected to a plastic second part 15*b* which is adapted for connection in the base structure 16 which, likewise, is of plastic. The plastic part 15*b* is secured to the ceramic part 15*a*** by plastic rivets formed, for example, on the plastic part as projecting pins or stubs, passing through suitable holes formed in the ceramic, and riveted over by ultrasonic riveting.

Suitable plastics for the plastic part **15*b* of the holder element 15 are high-temperature resistant plastics known under the trade names "Ultem 2300" and "Ryton". The base structure 16, for example, may be made of a polyamide (nylon). These materials are also suitable for the structure in accordance with FIG. 1**.

The base structure 16 does not have a bottom wall as such; the function of the bottom wall is taken over by a cover element 17 which is snap-connected to the lower end of the base structure 16. The base structure 16 can be in sleeve form. The holder element 15, the base structure 16 and the cover element 17 define therebetween a hollow space which, as before, is filled with a plastic resin. The positioning or adjustment ring 18 is unitary with the base structure 16.

Embodiment of FIG. 3: The details of the structure of FIG. 3 are described in the copending application U.S. Ser. No. 005,685, filed Jan. 21, 1987, Gaugel, now U.S. Pat. No. 4,722,039 (claiming priority of German Appln, No. P 36 03 743.5 of Feb. 6, 1986). As best seen in FIG. 3, a double-ended high-pressure discharge lamp 19 is used which corresponds, in operating characteristics, to the single-ended lamp 14 of FIG. 2. Lamp 19 is retained in a bulb holder element 20 which, again, is a two-part structure. The holder element 20 includes a plastic part **20*b* which is connected to a generally L-shaped ceramic part 20*a* having a base portion 20*a*1 and an upstanding portion 20*a*2. The ceramic and plastic parts are secured together, again, by ultrasonic riveting-over a plastic pin or stub 25, passed through an opening in the ceramic portion 20a1—see FIG. 3**.

The ceramic L-shaped part 20a includes a round base plate 20a1 which is fitted on the plastic part 20b of the holder 20. The plate 20a1 is integral with a trough-shaped elongated portion 20a2 which extends in parallel to the lamp 19. The current supply lead 21, extending from the bulb 19 at the side remote from the base, is electrically connected to a terminal element 22 secured in a groove or hole in the trough-shaped elongated portion 20a2. The terminal 22, in turn, is connected to a connecting line 24 which extends to one of the externally accessible blade terminals 23. The connection 24 is retained in a groove or recess formed on the side of the trough-shaped portion 20a2 facing away from the lamp 19.

The trough-shaped portion 20a2 of the holder 20 additionally has the function of a light shielding structure in addition to holding the double-ended bulb 19 in position, as described in detail in the referenced copending application, now U.S. Pat. No. 4,722,039.

Various changes and modifications may be made, and features described in connection with any one of the embodiments may be used with any of the others, within the scope of the inventive concept.

We claim:

1. Electric lamp bulb attachment arrangement, for attachment of a bulb (1, 14, 19) to a plastic base structure (5, 16) with the aid of a bulb holder element (4, 15, 20) in which lamp electrode leads (3, 24) are provided, connected to at least two terminals, said base structure (5, 16) comprising a hollow, at least part-tubular, structure, of an arbitrarily selected plastic material, defining an internal opening;

wherein a bulb holder element (4, 15, 20), of high-temperature-resistant plastic material, is provided, holding the bulb in position and fitting directly into said opening of the hollow base structure, said holder element retaining the bulb (1, 14, 19) thereon; and a coupling means (11), of material exhibiting a ferromagnetic response to high-frequency welding fields, is provided, located between the bulb holder element and the hollow base structure, at least in said region of seating engagement, said bulb holder element and said base structure being plastic-welded together with said coupling means (11) at least partially interposed.

2. The arrangement of claim 1, wherein said coupling means comprises a sheet or foil element.

3. The arrangement of claim 1, wherein the ferromagnetic coupling means comprises a ring-shaped structure (11) of ferromagnetic material.

4. The arrangement of claim 3, wherein the bulb holder element (4, 15, 20) is formed with a circumferential groove (12) in the region of fitting and seating engagement with the base structure (5, 16);

and wherein said ring-shaped structure (11) is seated in said groove (12).

5. The arrangement of claim 3, wherein said ring (11) is formed with apertures (13), at least in part filled with molten plastic material.

6. The arrangement of claim 3, wherein said ring (11) is a split ring only partially surrounding said bulb holder element (4, 15, 20).

7. The arrangement of claim 1, wherein said bulb holder element (4, 15, 20) is substantially barrel-shaped and convexly bowed towards the inner wall surfaces of the base structure (5, 16) to form said fitting and seating engagement.

8. The arrangement of claim 7, wherein a cross section of the opening of said hollow base structure (5, 16) is circular;

and the cross section, in a direction of seating engagement of the bulb holder element (4, 15, 20), is circular.

9. The arrangement of claim 7, wherein the bulb holder element (4, 15, 20), at least in the region of fitting and seating engagement with the hollow base structure (5, 16) is substantially part-spherical.

10. Electric lamp bulb attachment arrangement, for attachment of a bulb (1, 14, 19) to a plastic base structure (5, 16) with the aid of a bulb holder element (15, 20) in which lamp electrode leads (3, 24) are provided, connected to at least two terminals, said base structure (16) comprising a hollow, at least part-tubular, structure, of an arbitrarily selected plastic material, defining an internal opening;

wherein a bulb holder element (15, 20) is provided, holding the bulb in position and fitting directly into said opening of the hollow base structure;

the bulb holder element (15, 20) comprises a two-part structure including a first lamp holder part (15a, 20a1, 20a2) of high-temperature-resistant, electrically insulating ceramic material, and retaining said bulb (14, 19); and a second part (15b, 20b) comprising high-temperature-resistant plastic material having the characteristic of melting-together and welding with the material of the base structure (5, 16);

and a coupling means (11), of material exhibiting a ferromagnetic response to high-frequency welding fields, is provided, located between the bulb holder element and the hollow base structure, at least in said region of seating engagement, said bulb holder element (15, 20) and said base structure (16) being plastic-welded together with said coupling means (11) at least partially interposed.

11. The arrangement of claim 10, wherein the high temperature-resistant plastic of the second part (15b, 20b) and the ceramic of the first part (15a, 20a) are connected together by ultrasonic riveting of plastic pin or stub elements (25) extending through apertures formed in the ceramic.

12. The arrangement of claim 1, wherein the bulb (1) comprises a halogen incandescent lamp.

13. The arrangement of claim 10, wherein the bulb (14) comprises a single-ended high-pressure discharge lamp.

14. The arrangement of claim 10, wherein the lamp (19) comprises a double-ended high-pressure discharge lamp.

15. A method of making an electric lamp including a lamp bulb attachment arrangement as claimed in claim 1, comprising the steps of providing a base structure formed as a hollow structure defining an internal opening in essentially at least part-tubular form;

seating a lamp bulb (1, 14, 19) on a bulb holder element which is shaped to fit into said opening of the base structure, said bulb holder element, at least in the region of seating engagement with the hollow structure, comprising high temperature resistant plastic material;

fitting ferromagnetic material (11) on a circumferential portion of the bulb holder element which engages the opening of the hollow structure;

orienting the bulb (1, 14, 19) with respect to the base structure in accordance with a desired orientation;

and exposing the base structure and the bulb holder element, including said ferromagnetic material, to a high-frequency field sufficient to melt the plastic materials of said bulb holder element and said hollow structure by interaction with said ferromagnetic material, to melt and weld together said bulb holder element and said base structure, with the bulb in oriented position.

16. The method of claim 15, wherein said bulb holder element is substantially barrel-shaped, and of circular cross section;

said internal opening is of circular cross-section;

and said step of orienting the bulb comprises moving the bulb and with it said substantially barrel-shaped bulb holder element axially, rotatably or tiltably within said opening prior to carrying out said step of welding together the bulb holder element and the base structure.

17. The method of claim 15, wherein said bulb holder element comprises a two-part structure having a plastic part (**15*b*, 20*b*) and a ceramic part (15*a*, 20*a*1, 20*a*2), said ceramic part being formed with openings therethrough and the plastic part being formed with integral pins or stubs (25**) extending through said openings;

and further including the step of joining said parts together by ultrasonically riveting-over the pins or stubs extending through the openings in said ceramic part.

* * * * *